US010215541B2

(12) United States Patent
Nicholson

(10) Patent No.: US 10,215,541 B2
(45) Date of Patent: Feb. 26, 2019

(54) CLAY TARGET SHOOTING SYSTEM

(71) Applicant: Bret David Nicholson, Tooele, UT (US)

(72) Inventor: Bret David Nicholson, Tooele, UT (US)

( * ) Notice: Subject to any disclaimer, the term of this patent is extended or adjusted under 35 U.S.C. 154(b) by 0 days.

(21) Appl. No.: 15/403,758

(22) Filed: Jan. 11, 2017

(65) Prior Publication Data

US 2017/0219318 A1 Aug. 3, 2017

Related U.S. Application Data

(60) Provisional application No. 62/277,479, filed on Jan. 12, 2016.

(51) Int. Cl.
*F41J 1/01* (2006.01)
*F41J 1/10* (2006.01)
*F41J 1/00* (2006.01)

(52) U.S. Cl.
CPC . *F41J 1/01* (2013.01); *F41J 1/10* (2013.01); *F41J 1/00* (2013.01)

(58) Field of Classification Search
CPC ..... F41J 1/10; F41J 1/00; F41J 1/01
USPC ..... 273/403–408
See application file for complete search history.

(56) References Cited

U.S. PATENT DOCUMENTS 2,494,210 A * 1/1950 Robinson ..... F41J 9/02 273/369
D523,907 S 6/2006 Law
7,644,927 B2 1/2010 Law
7,845,646 B1 * 12/2010 Weber ..... F41J 1/10 273/407
7,946,588 B1 * 5/2011 Hockman ..... F41J 3/00 273/406
9,784,539 B1 * 10/2017 Preuss ..... F41J 1/10
2005/0006848 A1 * 1/2005 Fort, II ..... F41J 1/10 273/407
2007/0013138 A1 * 1/2007 Hinnant ..... F41J 1/01 273/407
2007/0176367 A1 * 8/2007 Hensley ..... F41J 1/10 273/348
2008/0272548 A1 11/2008 Hensley
2012/0068412 A1 * 3/2012 Diercks ..... F41J 1/10 273/407
2013/0001880 A1 * 1/2013 Dean ..... F41J 1/10 273/407

(Continued)

*Primary Examiner* — Mark Graham
(74) *Attorney, Agent, or Firm* — Ray Quinney & Nebeker P.C.; Paul N. Taylor

(57) ABSTRACT

A target is described that includes a plurality of clay targets and a clay target connector having a plurality of clamping ends. Each clamping end is releasably connected to a clay target. A target support structure is described that includes a tension line and a first and second support leg. The tension line is suspended between the first and second support leg with a horizontal tension. First and second guy lines are connected to first and second support legs. A target is suspended from the tension line. The target includes a plurality of clay targets and a clay target connector. The clay target connector includes a plurality of clamping ends. Each clamping end of the plurality of clamping ends is releasably connected to a clay target of the plurality of clay targets. A method to suspend a target is also described.

17 Claims, 3 Drawing Sheets

(56) References Cited

U.S. PATENT DOCUMENTS

| | | | | |
|---|---|---|---|---|
| 2013/0241152 | A1* | 9/2013 | Fodera | F41J 1/10<br>273/407 |
| 2014/0284879 | A1 | 9/2014 | Hendrix | |
| 2014/0300055 | A1 | 10/2014 | Papp | |

* cited by examiner

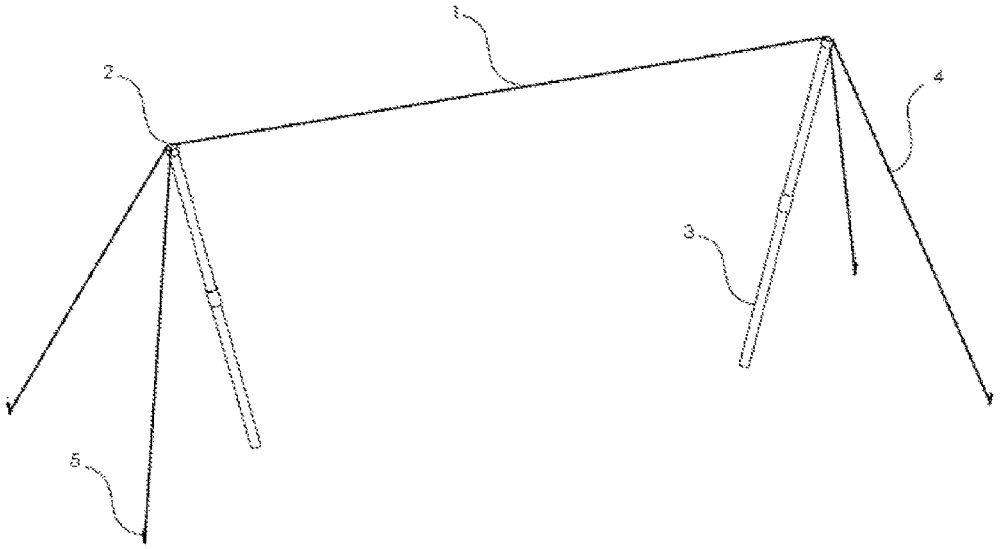
Figure 1 – Target support assembly, major components
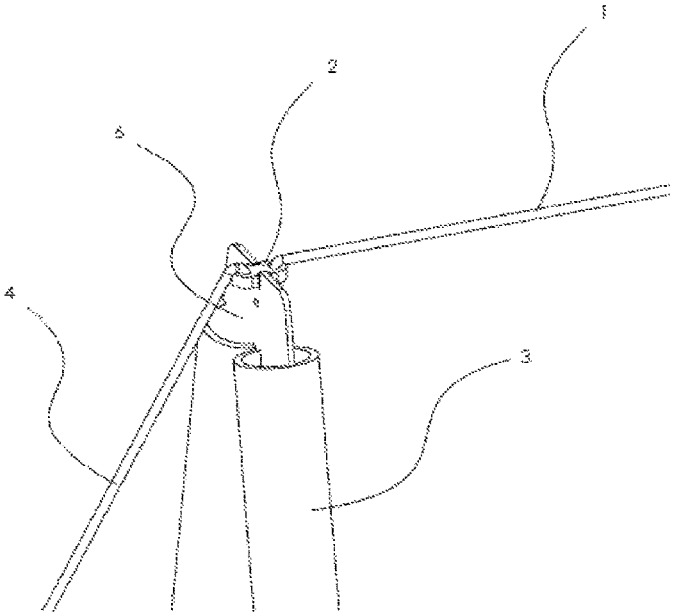
Figure 2 – Components of an alternate embodiment of the target support concept

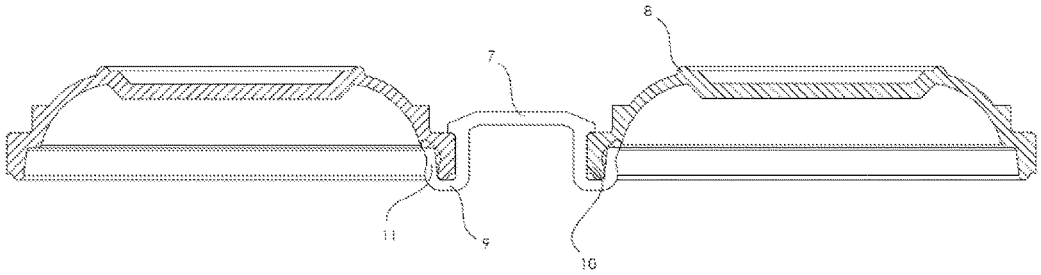
Figure 3 – Cross-sectional view of one embodiment of the clay target connector concept
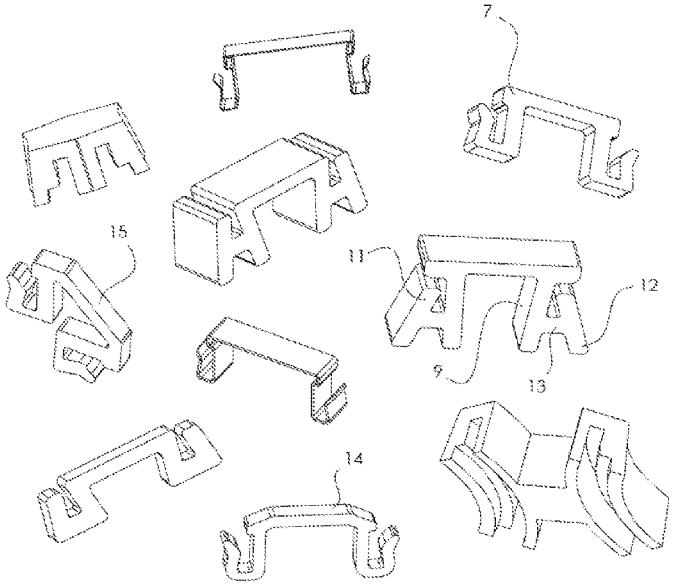
Figure 4 – Several possible embodiments of the clay target connector concept

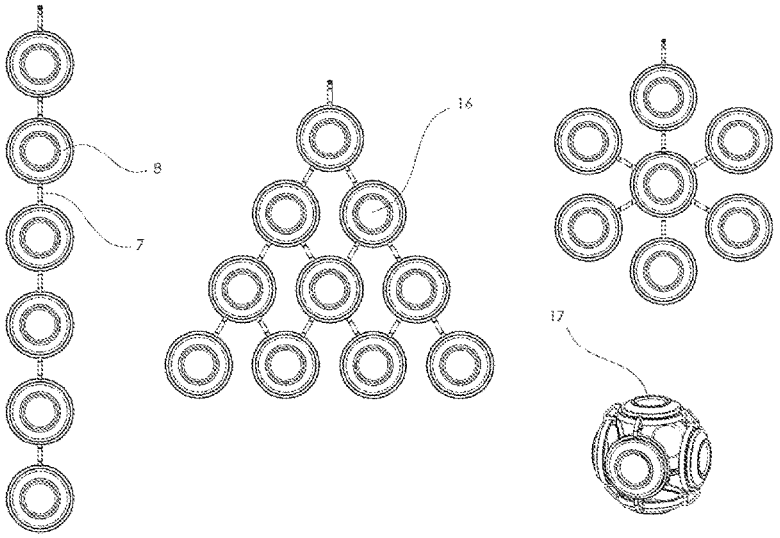
Figure 5 – Various possible arrangements of clay targets connected using target connectors
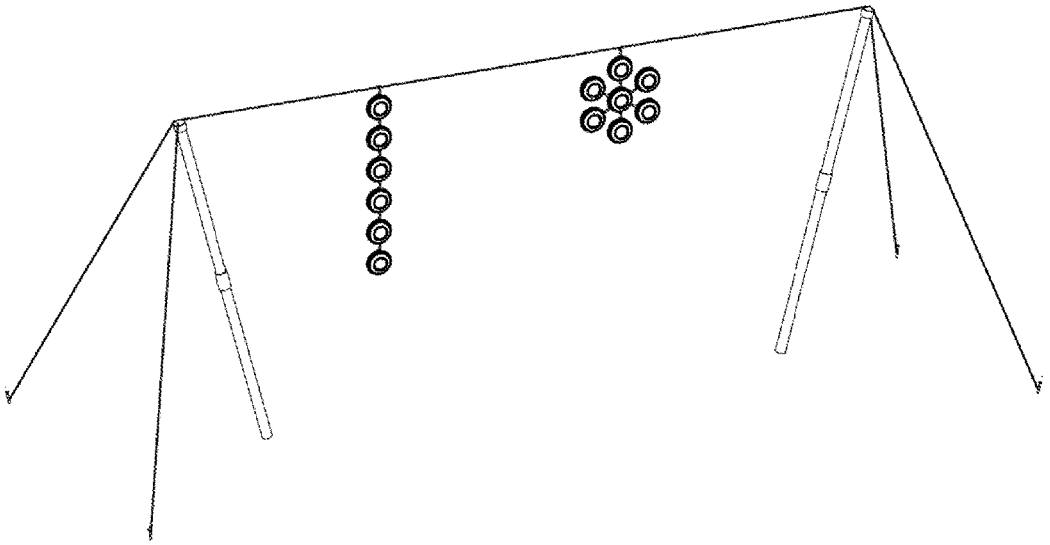
Figure 6 – Various possible arrangements of clay targets connected using target connectors

CLAY TARGET SHOOTING SYSTEM

CROSS REFERENCE TO RELATED APPLICATIONS

This application claims benefit of and priority to U.S. Provisional Patent Application No. 62/277,479, filed on Jan. 12, 2016.

BACKGROUND INFORMATION

The target shooting products available on the market today typically include one or both of two primary components, 1) a target, and 2) a means of holding or supporting the target. These components are used both in recreational target shooting, as well as training exercises to improve marksmanship. Typically, the target has a fixed shape or design (i.e. a pattern or image printed on paper, a metal plate cut into a particular shape, a molded polymer figure, etc.). The means of holding these targets may vary, but typically include some structural mechanism in order to both support the target and prevent or reduce movement during shooting.

BRIEF SUMMARY OF THE PRESENT INVENTION

The present invention includes both of the primary components mentioned above. The means of target support could be used with a wide variety of targets (patterns printed on paper, metal plates, suspended metal cans or plastic bottles, etc.). The part of the target support to which these targets are connected is substantially horizontal tension line. The means of maintaining tension in the line is the novel concept presented herein. The two ends of the line are secured to the ground by attaching additional tension lines to stakes. The tension is created by placing a set of rigid support legs in between the staked ends of the lines and the middle section of the line from which the targets are suspended. A means of preventing motion of the connection point of the legs relative to the tension line is also included herein. One of the primary advantages of this concept is the simplicity of its setup and takedown. After the line is secured to the ground stakes, the support legs can very quickly be put into place and the support is then ready to attach targets. Disassembly is as simple as removing the support legs and ground stakes.

While any target that can be suspended from a line could be compatible with this support mechanism, the present invention also includes a novel target design as well. The concept itself is not a target per se, but rather a means of allowing the user to create a customized target using readily available sporting clays, also known as clay pigeons. Several products available on the market today allow a shooter to support or attach a clay target to a support (a horizontal line or plank, a piece of cardboard, or a resting place on which a clay target can balance). These usually have a feature designed to interface with the clay target in such a way that it can be supported from underneath or suspended from above. The present invention is unique however in its ability not only to support the clay target, but also to attach it to other clay targets, allowing the target shooter to create any number of shapes or designs. This concept provides at least two attachment features so that multiple clay targets can be connected to one another to create a target.

SUMMARY OF FIGURES

FIG. 1—One embodiment of the target support concept and its major components FIG. 2—Components of an alternate embodiment of the target support concept FIG. 3—A cross-sectional view of one embodiment of the clay target connector concept FIG. 4—Several possible embodiments of the clay target connector concept FIG. 5—Various possible arrangements of clay targets connected using target connectors FIG. 6—Target support concept with connected clay targets

DETAILED DESCRIPTION OF VARIOUS EMBODIMENTS/DRAWINGS

FIG. 1 illustrates a preferred embodiment of a target support concept. The major components include a horizontal tension line 1, connection points 2, support legs 3, guy lines 4, and ground stakes 5. The tension line 1 is connected to the guy lines 4 at the connection points 2 such that length of the horizontal tension line 1 remains constant. The guy lines 4 also have a fixed length so that the entire length of line between the stakes 5 does not change. When the support legs 3 are placed in between the connection points 2 and the ground, the lines 1, 4 are put into tension. By moving the ground ends of the support legs 3 apart from one another, the tension in the lines 1, 4 increases.

By moving the bottoms of the support legs 3 inward, tension in the lines 1, 4 is relieved to the point where the support legs 3 can be disconnected from the connection points 2 and the whole support can be taken down. This concept assumes that the bottoms of the support legs 3 remain in the same position when in contact with the ground. The tension in the lines 1, 4 creates a downward force along the length of the support legs 3, which prevents any motion of the ends of the legs 3 relative to the ground.

The tension lines 1, 4 could be any flexible material capable of withstanding the tension forces applied during setup and target support. Possible materials include paracord, rope, wire cable, etc. The support legs 3 could be made from any rigid material capable of withstanding the compression forces resulting from the lines 1, 4 in tension. Possible materials include plastic, wood, composite, metal, etc. The ground stakes 5 could also be made from a variety of materials as long as they are able to remain anchored in the ground when connected to the line 1 while in tension.

FIG. 2 illustrates an alternate embodiment of the target support concept. One primary difference between this and the preferred embodiment is the number of support legs 3 and guy lines 4. The setup is basically the same for both embodiments. The alternate embodiment also has an additional joint component 6 that connects the two support legs 3 together, and also connects to the connection point 2 attached to the tension line 1 and guy line 4.

FIG. 3 provides a cross-sectional view of a preferred embodiment of a clay target connector 7 connected to a clay target 8. The connector 7 is made of a flexible material (such as plastic, rubber, thin metal, etc.) that allows its clamping ends 9 to pinch the edge 10 of the clay target 8 in order to stay connected. In order for these clamping ends 9 to grip the edge 10 of a clay target 8, they have a profile that is smaller than that of the edge 10 of the clay target 8. When sides 11 of the clamping end 9 are separated, the edge 10 of the clay target 8 can be placed inside the profile of the clamping end 9. When the sides 11 of the clamping end 9 are no longer being forced open, they return toward their original shape causing an interference fit and a pinching force at the edge 10 of the clay target 8. Each connector 7 has two or more clamping ends 9, allowing multiple clay targets 8 to be connected together in any number of configurations. These clamping ends 9 could have two or more sides 11 in order to achieve the pinching or interference fit.

FIG. 4 illustrates several possible embodiments of clay target connectors 7. The clamping ends 9 of the connectors 7 could have side extensions 12 in order to facilitate the opening of the sides 11 of the clamping ends 9. The side extensions 12 are located on the opposite side of the flexing section 13 of the clamping end 9. Thus forcing the extensions 12 closer together would cause the sides 11 of the clamping ends 9 to separate so that they could more easily be placed over the edge 10 of the clay target 8.

The target connectors 7 could have a flat mid-section 14 or a non-flat mid-section 15. Connectors 7 with flat mid-sections 14 could be used to create a flat, two-dimensional target 16 (see FIG. 5) by connecting multiple clay targets 8 together. Connectors 7 with non-flat mid sections 15 could be used to create a three-dimensional target 17 (see FIG. 5). By making the mid-section flexible, either two-dimensional 16 or three-dimensional 17 targets could be created (see FIG. 5).

FIG. 5 illustrates various possible configurations of two-dimensional 16 and three-dimensional 17 targets constructed with clay targets 8 and target connectors 7.

FIG. 6 illustrates both the target support and target components together. Both of these components could be used independently, but used together they comprise a complete target shooting system.

The invention claimed is:

1. A target, comprising:

a plurality of clay targets each having an outer largest dimension; and a clay target connector having a width and a plurality of clamping ends, the width of the clay target connector smaller than the outer dimension of a clay target of the plurality of clay targets, each clamping end of the plurality of clamping ends is releasably connected to a clay target of the plurality of clay targets.

2. The target of claim 1, further comprising:

a first clay target and a second clay target of the plurality of clay targets; and a first clamping end and a second clamping end, the first clamping end is releasably connected to the first clay target, and the second clamping end is releasably connected to the second clay target.

3. The target of claim 2, wherein the second clay target is releasably connected to a plurality of clay target connectors, and wherein each clay target connector of the plurality of clay target connectors is releasably connected to two clay targets.

4. The target of claim 3, wherein each clay target connector of the plurality of clay target connectors includes a flat mid-section, the target forming a two-dimensional target.

5. The target of claim 3, wherein each clay target connector of the plurality of clay target connectors includes a non-flat mid-section, the target forming a three-dimensional target.

6. The target of claim 1, wherein the clay target connector is fabricated from a flexible material, and wherein a first clamping end and a second clamping end of the plurality of clamping ends have a profile that is smaller than an edge of an outer surface of a first clay target and a second clay target of the plurality of clay targets.

7. The target of claim 6, wherein the first and second clamping ends of the plurality of clamping ends include at least two pinching sides configured to engage opposing inner surfaces and outer surfaces of the clay target, the at least two pinching sides including two extensions extending past a flexing section, the two extensions configured to spread the two pinching sides when compressed inward.

8. A target support structure, the target support structure comprising:

a tension line;

a first support leg and a second support leg;

wherein the tension line is suspended between the first support leg and the second support leg with a horizontal tension;

a first guy line connected to the first support leg and a second guy line connected to the second support leg; and a first ground stake, connected to the first guy line and staked into the ground, and a second ground stake, connected to the second guy line and staked into the ground;

wherein the first guy line is tensioned with a first tension between the first support leg and the first ground stake, and the second guy line is tensioned with a second tension between the second support leg and the second ground stake;

wherein the first tension, the second tension, and the horizontal tension are maintained by placement of the first support leg and the second support leg;

a target suspended from the tension line, the target including:

a plurality of clay targets each having an outer largest dimension; and a clay target connector, wherein the clay target connector includes a width and a plurality of clamping ends, the width of the clay target connector smaller than the outer dimension of a clay target of the plurality of clay targets, each clamping end of the plurality of clamping ends is releasably connected to a clay target of the plurality of clay targets.

9. The target support structure of claim 8, wherein the first support leg includes two legs, and wherein the two legs are connected at a first joint with the first guy line and a first end of the horizontal tension line, and the second support leg includes two legs, and wherein the two legs are connected at a second joint with the second guy line and a second end of the horizontal tension line.

10. The target support structure of claim 8, further comprising a third guy line connected to the first support leg and a fourth guy line connected to the second support leg.

11. A method to suspend a target, the method comprising:

connecting a tension line with a first guy line and a first support leg at a first connection point, and connecting the tension line with a second guy line and a second support leg at a second connection point;

staking the first guy line to the ground with a first ground stake, and staking the second guy line to the ground with a second ground stake;

placing the first support leg beneath the first connection point and the second support leg beneath the second connection point such that the support line, the first guy line, and the second guy line are tensioned;

assembling the target by connecting a plurality of the clay targets of claim 1 to the clay target connector of claim 1, the clay target connector includes the plurality of clamping ends of claim 1, each clamping end of the plurality of clamping ends releasably connected to a clay target from a plurality of clay targets of claim 1; and suspending the target from the tension line.

12. The method of claim 11, wherein placing the first support leg includes placing two legs beneath the first connection point, the two legs connecting at the first connection point, and placing the second support leg includes placing two legs beneath the second connection point, the two legs connecting at the second connection point.

13. The method of claim 11, further comprising releasably connecting a first clamping end to a first clay target, and releasably connecting a second clamping end to a second clay target.

14. The method of claim 13, further comprising releasably connecting the second clay target to a plurality of clay target connectors.

15. The method of claim 14, further comprising creating a two-dimensional target by releasably connecting the second clay target to a plurality of clay target connectors having a flat mid-section.

16. The method of claim 14, further comprising creating a three-dimensional target by releasably connecting the second clay target to a plurality of clay target connectors having a non-flat mid-section.

17. The target of claim 1, wherein the clay target connector includes a mid-section that orients the plurality of clamping ends at an angle between 0 and 90 degrees relative to each other.

* * * * *